US011612187B2

(12) United States Patent
Ouyang

(10) Patent No.: US 11,612,187 B2
(45) Date of Patent: Mar. 28, 2023

(54) ATOMIZING DEVICE OF ELECTRONIC CIGARETTE AND AN ELECTRONIC CIGARETTE

(71) Applicant: HONG KONG IVPS INTERNATIONAL LIMITED, Central (HK)

(72) Inventor: Junwei Ouyang, Shenzhen (CN)

(73) Assignee: Hong Kong IVPS International Limited, Central (HK)

( * ) Notice: Subject to any disclaimer, the term of this patent is extended or adjusted under 35 U.S.C. 154(b) by 397 days.

(21) Appl. No.: 16/850,107

(22) Filed: Apr. 16, 2020

(65) Prior Publication Data

US 2020/0329768 A1 Oct. 22, 2020

(30) Foreign Application Priority Data

Apr. 17, 2019 (CN) ..... 201910308891.X

(51) Int. Cl.

| | |
|---|---|
| ***A24F 40/485*** | (2020.01) |
| ***A24F 40/46*** | (2020.01) |
| ***A24F 40/44*** | (2020.01) |
| ***A24F 40/42*** | (2020.01) |
| *A24F 40/48* | (2020.01) |

(52) U.S. Cl.

CPC ..... *A24F 40/485* (2020.01); *A24F 40/42* (2020.01); *A24F 40/44* (2020.01); *A24F 40/46* (2020.01); *A24F 40/48* (2020.01)

(58) Field of Classification Search

None

See application file for complete search history.

(56) References Cited

U.S. PATENT DOCUMENTS

| | | | | |
|---|---|---|---|---|
| 2019/0037920 | A1* | 2/2019 | Qiu | H05B 1/0227 |
| 2020/0060343 | A1* | 2/2020 | Tan | A24F 40/42 |
| 2020/0329768 | A1* | 10/2020 | Ouyang | A24F 40/46 |
| 2021/0378297 | A1* | 12/2021 | Beer | A24F 15/015 |

FOREIGN PATENT DOCUMENTS

| | | | |
|---|---|---|---|
| CN | 107874323 | A | 4/2018 |
| WO | 2018/018608 | A1 | 2/2018 |

OTHER PUBLICATIONS

European Patent Office, Search Report and Search Opinion, European Patent Application No. 20170065.5, 7 pages, dated Aug. 14, 2020.

* cited by examiner

*Primary Examiner* — James Harvey
(74) *Attorney, Agent, or Firm* — Thompson Hine LLP

(57) ABSTRACT

The present disclosure discloses an atomizing device of an electronic cigarette. The atomizing device includes a base including a juice storage cavity and an installation cavity, and an atomizing core component including a first part, a second part, and a juice guide hole that connects with an inner part of the atomizing core component. The atomizing core component is configured to be pre-installed on a first position on the base, and when the first part is inserted into the installation cavity, the second part protrudes outside of the base, and the juice guide hole can be covered by the base. The atomizing core component is configured to move to a second position on the base and the juice guide hole connects with the juice storage cavity when the second part of the atomizing core component is squeezed by an external force.

26 Claims, 12 Drawing Sheets

ATOMIZING DEVICE OF ELECTRONIC CIGARETTE AND AN ELECTRONIC CIGARETTE

CROSS-REFERENCE TO RELATED APPLICATION

This application claims priority to Chinese Patent Application No. 201910308891.X, filed on Apr. 17, 2019. The disclosure of the foregoing application is incorporated herein by reference in its entirety.

TECHNICAL FIELD

The present disclosure relates to an electronic cigarette atomizing device and an electronic cigarette with this atomizing device thereof.

BACKGROUND

Electronic cigarette, also called e-cigarette, is mainly used to quit smoking and replace traditional cigarettes. It has a similar appearance and similar taste to traditional cigarettes, even has more flavors than traditional cigarettes. It can also make smoke, have taste, and feel like traditional cigarettes. Electronic cigarette is gradually replacing traditional cigarette in the market because it is free of tar, suspended particulates, and other harmful components in traditional cigarette. Small electronic cigarette is portable, so it is very popular.

However, the atomizing device in traditional small electronic cigarette is usually a cartridge pre-filled with juice, and the juice in the juice storage cavity tends to penetrate the core of atomizing core component during transportation, which leads to juice leakage.

SUMMARY

The purpose of present disclosure is to provide an electronic cigarette atomizing device, aiming at preventing juice leakage from the electronic cigarette atomizing device during transportation.

To achieve the above purpose, the present disclosure discloses an electronic cigarette atomizing device, which include a base and an atomizing core component. The base includes a juice storage cavity for accommodating cigarette liquid and an installation cavity coupled with the juice storage cavity. The atomizing core component includes a first part, a second part, and a juice guide hole that is coupled to an inner part of the atomizing core component, and is provided on the outer wall of the atomizing core component between the first part and the second part.

In some embodiments, the atomizing core component is configured to be pre-installed on a first position on the base, and when the first part of the atomizing core component is inserted into the installation cavity, the second part of the atomizing core component protrudes outside of the base, and the juice guide hole is covered by the base.

In some embodiments, when the second part of the atomizing core component is squeezed by an external force, the atomizing core component is configured to move to a second position on the base and the juice guide hole connects with the juice storage cavity.

In some embodiments, the juice guide hole is in the juice storage cavity when the atomizing core component is in the second position.

In some embodiments, the base further includes a case with an opening and a seal seat, wherein the seal seat is configured to seal the opening and form the juice storage cavity with inner walls of the case, and the seal seat is provided with the installation cavity.

In some embodiments, the juice guide hole is covered by the seal seat when the atomizing core component is pre-installed at the first position on the base.

In some embodiments, the seal seat is a flexible sealing element. In some embodiments, when the first part of atomizing core component is inserted into the installation cavity of the seal seat, the inner wall of the installation cavity is flexible and closely matched with the outer wall of the atomizing core component.

In some embodiments, when the second part of the atomizing core component is squeezed by external force, the atomizing core component is configured to move towards the base relative to the seal seat.

In some embodiments, the base is further includes an air duct, wherein one end of the air duct protrudes outside of the atomizing device and the other end of the air duct is inserted into the juice storage cavity. In some embodiments, when the atomizing core component is pre-installed at the first position on the base, the first part of the atomizing core component can be inserted into the air duct through the installation cavity.

In some embodiments, the juice guide hole is in the juice storage cavity when the atomizing core component is in the second position.

In some embodiments, the atomizing device further includes a seal ring positioned between the first part and the air duct. The inner ring surface of the sealing ring is sleeved on the outer surface of the first part of the atomizing core component, and the outer ring surface elastically abuts against the inner tube wall of the air duct.

In some embodiments, the seal ring is pre-installed on the air duct and opening on the inner ring surface at the end of the sealing ring facing the installation cavity is gradually expanded.

In some embodiments, the atomizing device further includes a support ring that is protruding on the inner wall of air duct, wherein when the seal ring is pre-installed inside the air duct, the end away from the installation cavity elastically abuts against the support ring.

In some embodiments, a cross-section enclosed by the inner ring surface of the sealing ring is greater than a cross-section enclosed by the inner ring surface of the support ring.

In some embodiments, the atomizing device further includes a limit stop that is protruding on a peripheral surface of the first part of the atomizing core component, and the limit stop is configured to limit the position of the atomizing core component when abutting against the air duct.

In some embodiments, the limit stop is a shoulder-shaped flange or a bump extending along circumferential direction of the first part of the atomizing core component.

In some embodiments, the end of the sealing ring facing the installation cavity is protrudes out of the air duct.

In some embodiments, the atomizing device further includes a limit stop that protrudes on a peripheral surface of second part of the atomizing core component, wherein the limit stop is configured to limit the position of the atomizing core component when abutting against the seal ring.

In some embodiments, the limit stop is a shoulder-shaped convex edge or a projecting part extending along circumferential direction of the second part.

In some embodiments, the atomizing device further includes an escape hole and an air duct. In some embodiments, one end of the air duct protrudes outside of the atomizing device, and the other end of the air duct is inserted into the juice storage cavity. In some embodiments, the escape hole is on a wall of juice storage cavity that is directly opposite to the air duct.

In some embodiments, when the atomizing core component is pre-installed at the first position on the base, the first part the atomizing core component is inserted into the air duct after passing through the installation cavity, the juice storage cavity, and the escape hole.

In some embodiments, the juice guide hole is in the juice storage cavity when the atomizing core component is in the second position on the base.

In some embodiments, the atomizing device further includes a hollow seal sleeve positioned between the first part of the atomizing core component and an inner wall of the escape hole. In some embodiments, the peripheral surface of the seal sleeve is tightly fitted on the inner wall of escape hole.

In some embodiments, the atomizing device further includes a seal groove on the peripheral surface of seal sleeve along the circumferential direction. In some embodiments, the seal sleeve is pre-installed inside the escape hole and is configured to make a hole edge at both ends of the escape hole inserted into the seal groove.

In some embodiments, the hollow seal sleeve is sleeved on part of a peripheral surface of the first part of the atomizing core component, and a length of the hollow seal sleeve is greater than the depth of the escape hole so that the peripheral surface of the hollow seal sleeve can tightly abut against the inner wall of the escape hole when the atomizing core component is at the first position or the second position on the base.

In some embodiments, the juice storage cavity further includes a passing juice orifice that is coupled to the installation cavity. In some embodiments, the installation cavity and the juice storage cavity are independent cavities in the base.

In some embodiments, when the atomizing core component is pre-installed on the first position on the base, a peripheral surface of the atomizing core component is configured to block the passing juice orifice.

In some embodiments, when the atomizing core component moves from the first position on the base to the second position on the base, the juice guide hole is configured to connect with the passing juice orifice.

In some embodiments, a surface of side of the atomizing core component that is directly opposite to the passing juice orifice is configured to tightly attach to the inner wall of base where the passing juice orifice is located so that juice in the juice storage cavity is configured to pass the juice guide hole through the passing juice orifice when the juice guide hole connects with the passing juice orifice.

In some embodiments, an opening of the juice guide hole is greater than an opening of the passing juice orifice.

The present disclosure further discloses an electronic cigarette. The electronic cigarette includes an atomizing device, and the atomizing device includes a base and an atomizing core component. The base includes a juice storage cavity for accommodating cigarette liquid and an installation cavity coupled with the juice storage cavity. The atomizing core component includes a first part, a second part, and a juice guide hole that is coupled to an inner part of the atomizing core component and is provided on an outer wall of atomizing core component between the first part and the second part. The atomizing core component is configured to be pre-installed on a first position on the base, and when the first part is inserted into the installation cavity, the second part protrudes outside of the base, and the juice guide hole is covered by the base. In some embodiments, when the second part of the atomizing core component is squeezed by an external force, the atomizing core component is configured to move to a second position on the base and the juice guide hole connects with the juice storage cavity.

In the technical scheme of present disclosure, the atomizing core component in the atomizing device of electronic cigarette is pre-installed at the first position on the base, so that the juice injection hole provided on the atomizing core component can be covered and blocked by the inner wall of base and juice in the juice storage cavity cannot flow into the atomizing core component. After purchasing the electronic cigarette, users only need to press the atomizing core component from the first position of base to the second position of base, so that the juice guide hole on the atomizing core component can connect with the juice storage cavity, then the juice in the juice storage cavity may flow into the atomizing core component for operation. It may effectively prevent juice leakage from the electronic cigarette atomizing device during transportation.

BRIEF DESCRIPTION OF THE DRAWINGS

For a more complete understanding of the present disclosure, or technical schemes in the prior art, drawings in the embodiments or the description of prior art will be briefly introduced. Obviously, drawings in the following description are only some embodiments of present disclosure, it will be apparent to those skilled in the art from this disclosure that other drawings may be easily obtained from these drawings without paying any creative effort.

DESCRIPTION OF REFERENCE NUMBERS IN THE DRAWINGS

Figure 1:
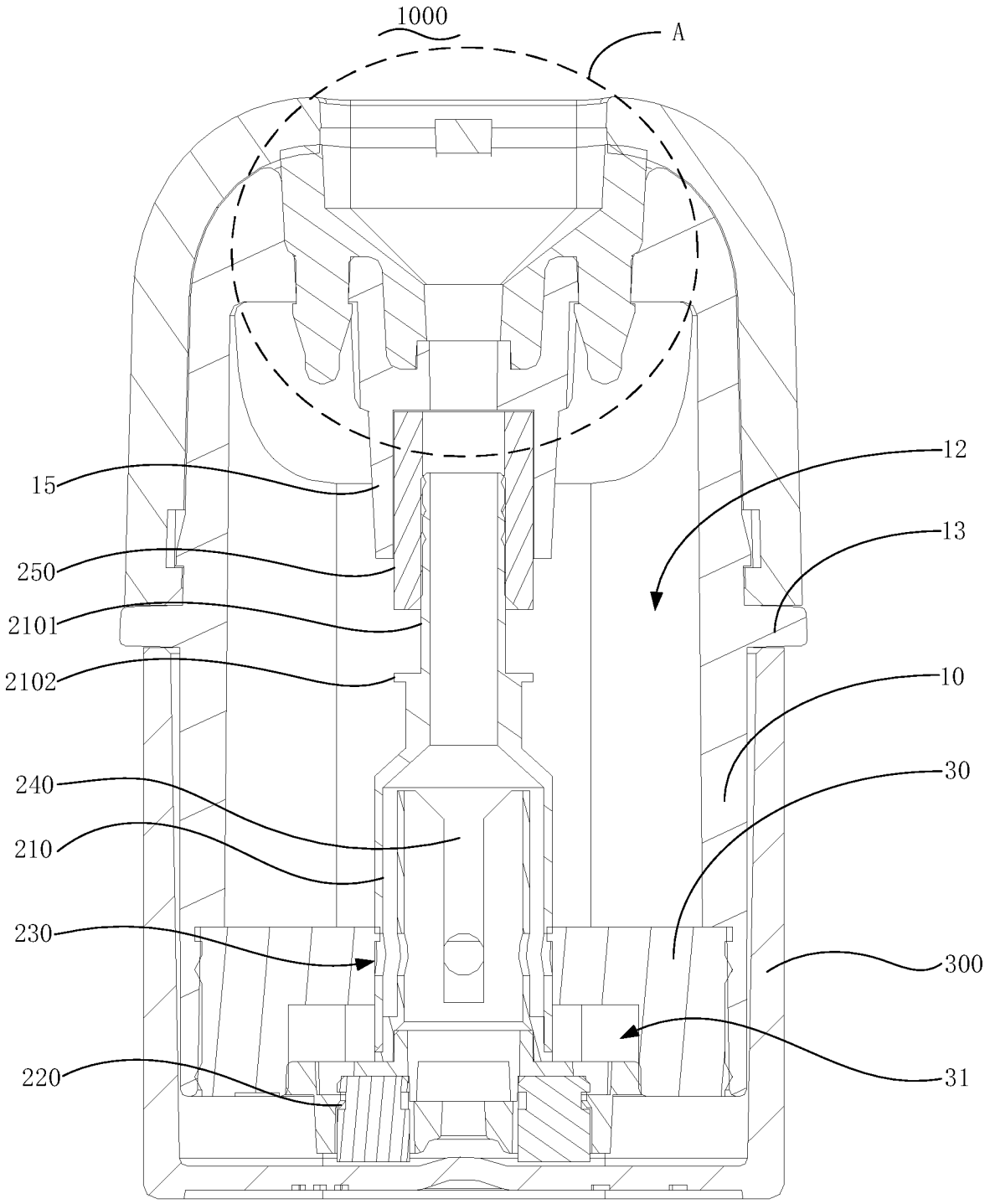
FIG. 1 is a schematic view showing the connection structure when the atomizing core component of electronic cigarette is at the first position of the base provided by the second embodiment of present disclosure.

| Reference number | Name |
|---|---|
| 1000 | atomizing device |
| 100 | base |
| 10 | case |
| 11 | opening |
| 12 | juice storage cavity |
| 121 | escape hole |
| 122 | seal sleeve |
| 1221 | seal groove |
| 13 | stop part |
| 14 | clamp part |
| 15 | air duct |
| 151 | support ring |
| 16 | juice injection hole |
| 17 | partition section |
| 171 | passing juice orifice |
| 18 | groove |
| 19 | accommodation slot |
| 20 | air guide edge |
| 30 | seal seat |
| 31 | installation cavity |
| 311 | large diameter section |
| 312 | small diameter |
| 32 | sealing convex edge |
| 33 | bump |
| 40 | seals |
| 50 | juice stop plug |
| 51 | plug head |
| 52 | Plug body |
| 53 | locking part |
| 54 | stop edge |
| 55 | installation seat |
| 551 | air passage |
| 200 | atomizing core component |
| 210 | first part |
| 2101 | connecting tube |
| 2102 | limit stop |
| 220 | second part |
| 230 | juice guide hole |
| 240 | atomizing cavity |
| 250 | seal ring |
| 2501 | sealing convex rib |
| 300 | protective cover |

The realization of objects, functional characteristics, and advantages of present disclosure will be further described in conjunction with the embodiments and with reference to the drawings.

DETAILED DESCRIPTION

Technical solutions according to embodiments of present disclosure are described clearly and completely in conjunction with the drawings in the embodiments of present disclosure hereinafter. Apparently, the described embodiments are only a few rather than all embodiments of present disclosure. Other embodiments obtained by those skilled in the art without any creative work based on embodiments of present disclosure fall within the scope of protection of present disclosure.

It should be noted that all directional indicators (such as up, down, left, right, front, back, etc.) in the embodiments of the present disclosure are only used to explain the relative position between the components in a specific posture (as shown in the drawings) and movement conditions, etc., if the specific posture changes, the directional indication also changes accordingly.

In the description of the present application, the "first", "second" are merely used for description, and cannot be understood to indicate or imply relative importance or implicitly indicate the number of the indicated technical features. Therefore, features with a limitation of "first" or "second" can explicitly or implicitly include one or more feature. Furthermore, technical schemes of various embodiments can be combined with each other if only it can be implemented by those of ordinary skill in the art. If a combination of the technical schemes is conflict or impracticable, the combination should be considered as not exist, and not fall in the scope of protection of the present disclosure.

In the present disclosure, unless otherwise expressly defined and limited otherwise, terms "connect," "couple," and "fix" should be understood broadly. For example, "fixed" may mean a fixed connection, a detachable connection, an integral connection, a mechanical connection, or an electrical connection. Additionally, "fixed" or "coupled" can be a direct connection, an indirect connection by an intermediary, or an inner connection of two elements, unless expressly defined otherwise. An ordinary skilled person in this field may construe the particular meaning of each of such terms based on the specific descriptions in the present disclosure.

Figure 9:
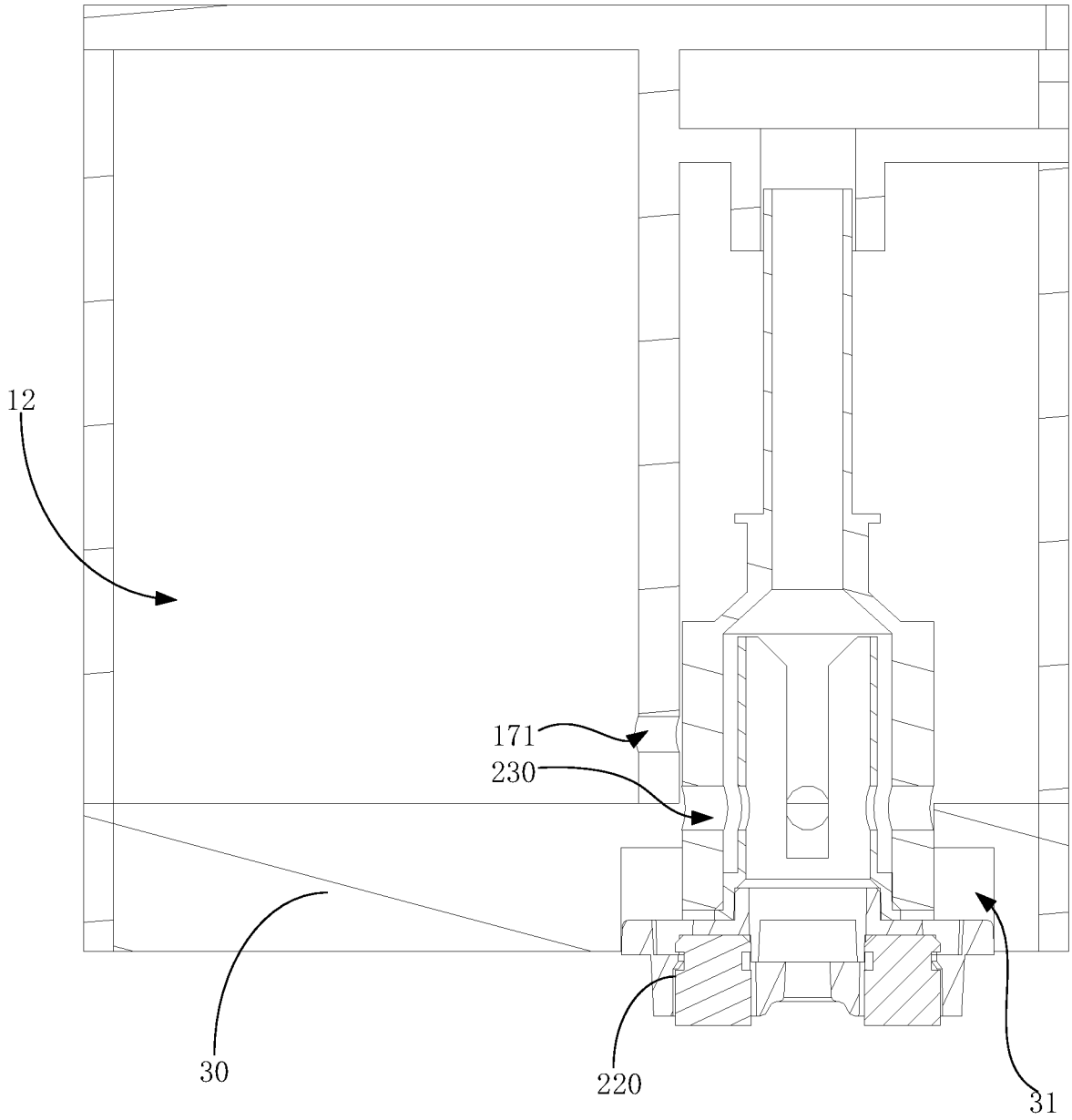
FIG. 9 is a sectional schematic view showing the connection structure when the atomizing core component is at the first position of base in the first embodiment of present disclosure.

The present disclosure discloses an electronic cigarette, comprising an atomizing device 1000 and a power supply unit supplying electric power to the atomizing device 1000. The atomizing device 1000 comprises a base 100 provided with a juice storage cavity 12 inside and the atomizing core component 200. The atomizing core component 200 is provided with an atomizing cavity 240 and a juice guide hole 230 that connects with the atomizing cavity 240, and a heating component are installed inside the atomizing cavity 240. In some embodiments, when the atomizing device 1000 is installed on the power supply unit, the heating component is electrically coupled to the power supply unit. The heating component heats the juice absorbed from the juice storage cavity to produce smoke under the action of electric power from the power supply unit. Refer to FIG. 1 or FIG. 9, in some embodiments of the present disclosure, the atomizing device 1000 comprises the base 100 and the atomizing core component 200. The base 100 comprises a base 100 with an opening 11, as well a seal seat 30 made of a flexible material. The seal seat 30 is used to seal the opening 11 and form the juice storage cavity 12 together with inner wall of the case 10. Furthermore, the seal seat 30 is provided with an installation cavity 31 for installing the atomizing core component 200, the atomizing core component comprises a first part 210 and a second part 220, and a juice guide hole 230 connecting with the atomizing cavity 240 in the atomizing core component 200 is provided on the outer wall of the atomizing core component 200 between the first part 210 and the second part 220. In some embodiments, when the atomizing core component 200 is pre-installed on the first position on the base 100, the first part 210 is inserted into the installation cavity 31, the second part 220 protrudes outside the base 100, and the juice guide hole 230 between the first part 210 and the second part 220 is covered by the seal seat 30 of the base 100 and elastically blocked. At this point, the juice storage cavity is an enclosed chamber, so that the juice stored inside the cavity cannot flow into the atomizing core component 200 through the juice guide hole 230. Therefore, juice will not leak out through air passage after penetrating the juice storage cavity 12 via the juice guide hole 230.

Figure 3:
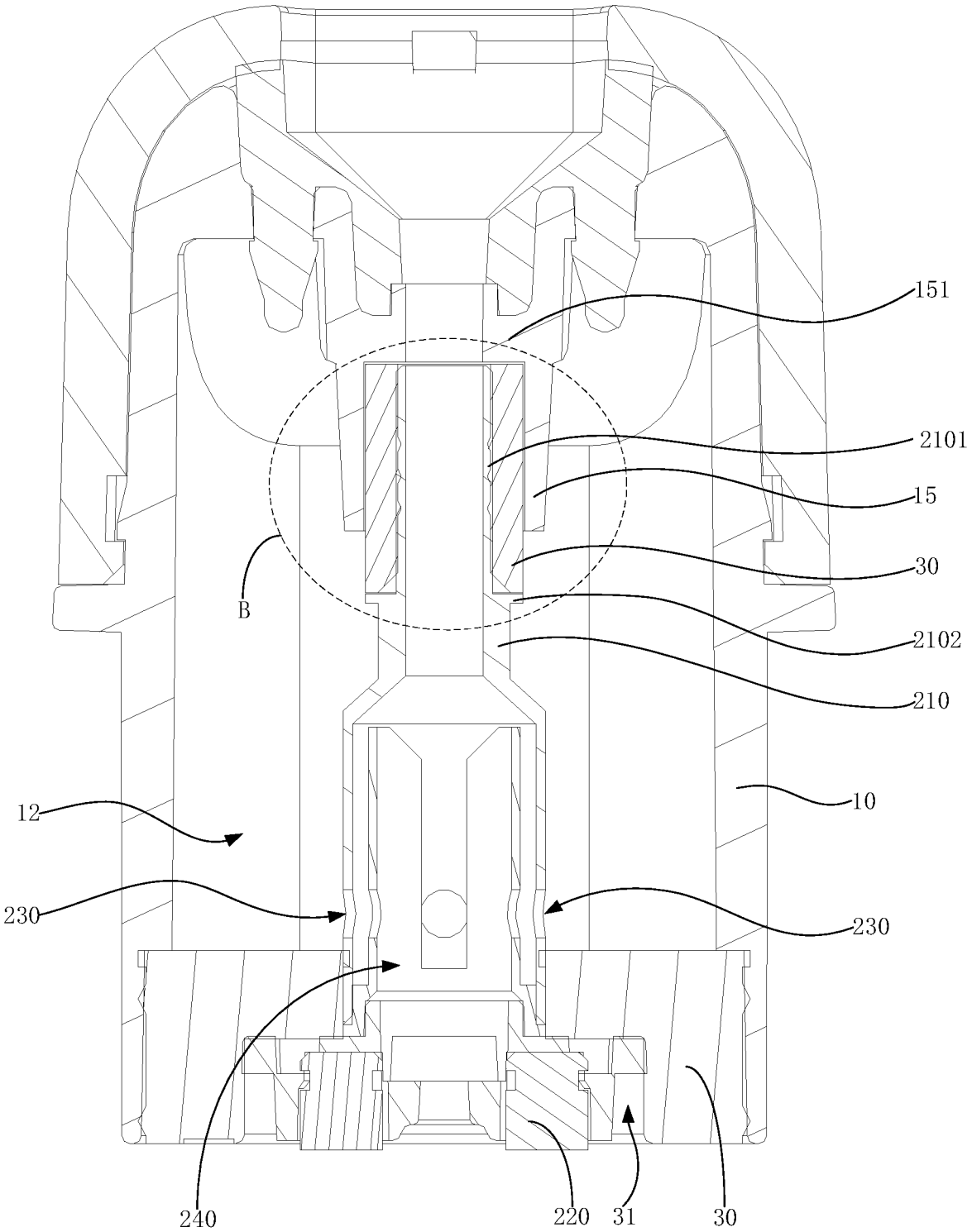
FIG. 3 is a schematic view showing the connection structure when the atomizing core component of electronic cigarette is at the second position of the base provided by the second embodiment of present disclosure.
Figure 10:
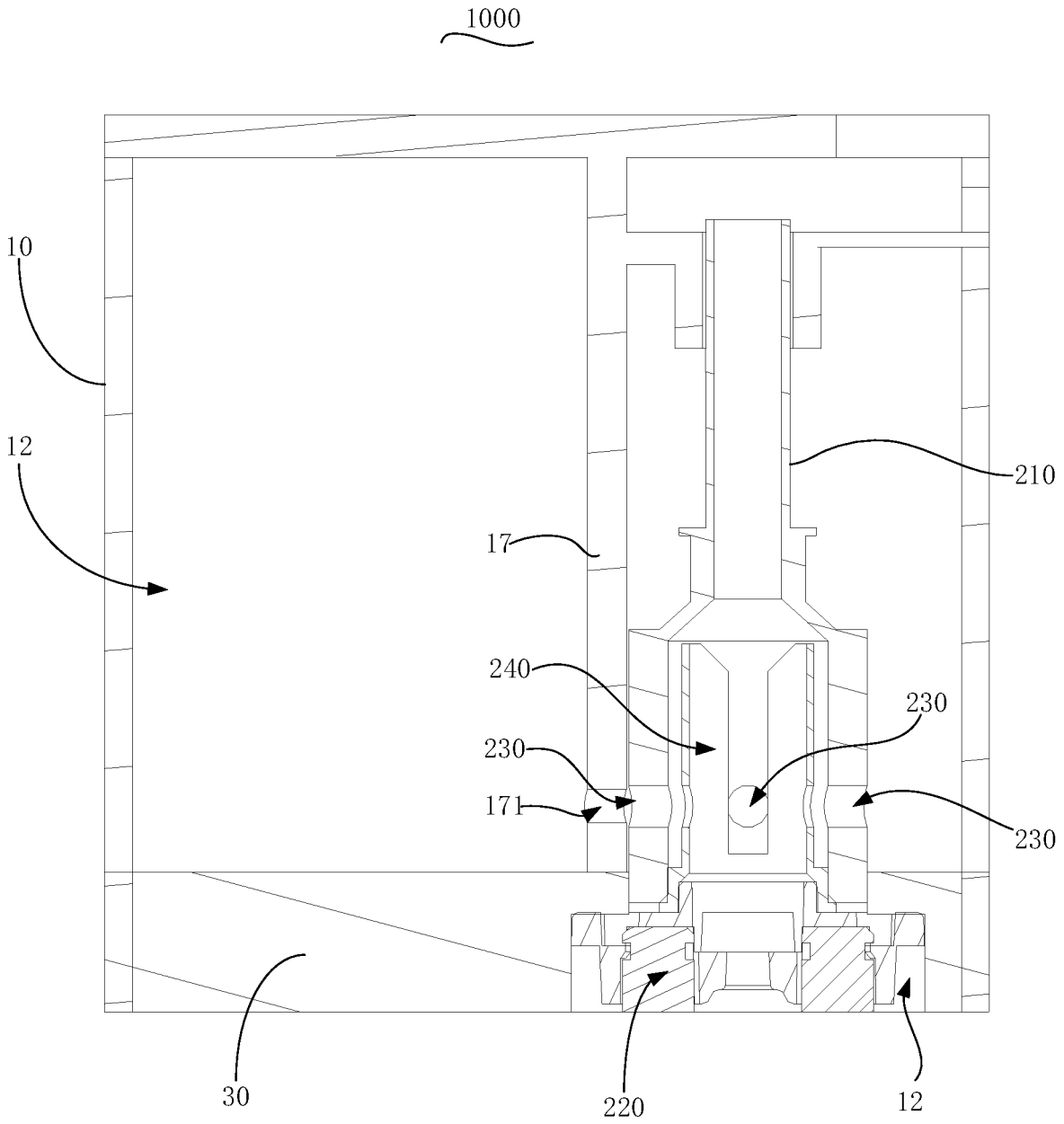
FIG. 10 is a sectional schematic view showing the connection structure when the atomizing core component is at the second position of base in the first embodiment of present disclosure.
Figure 11:
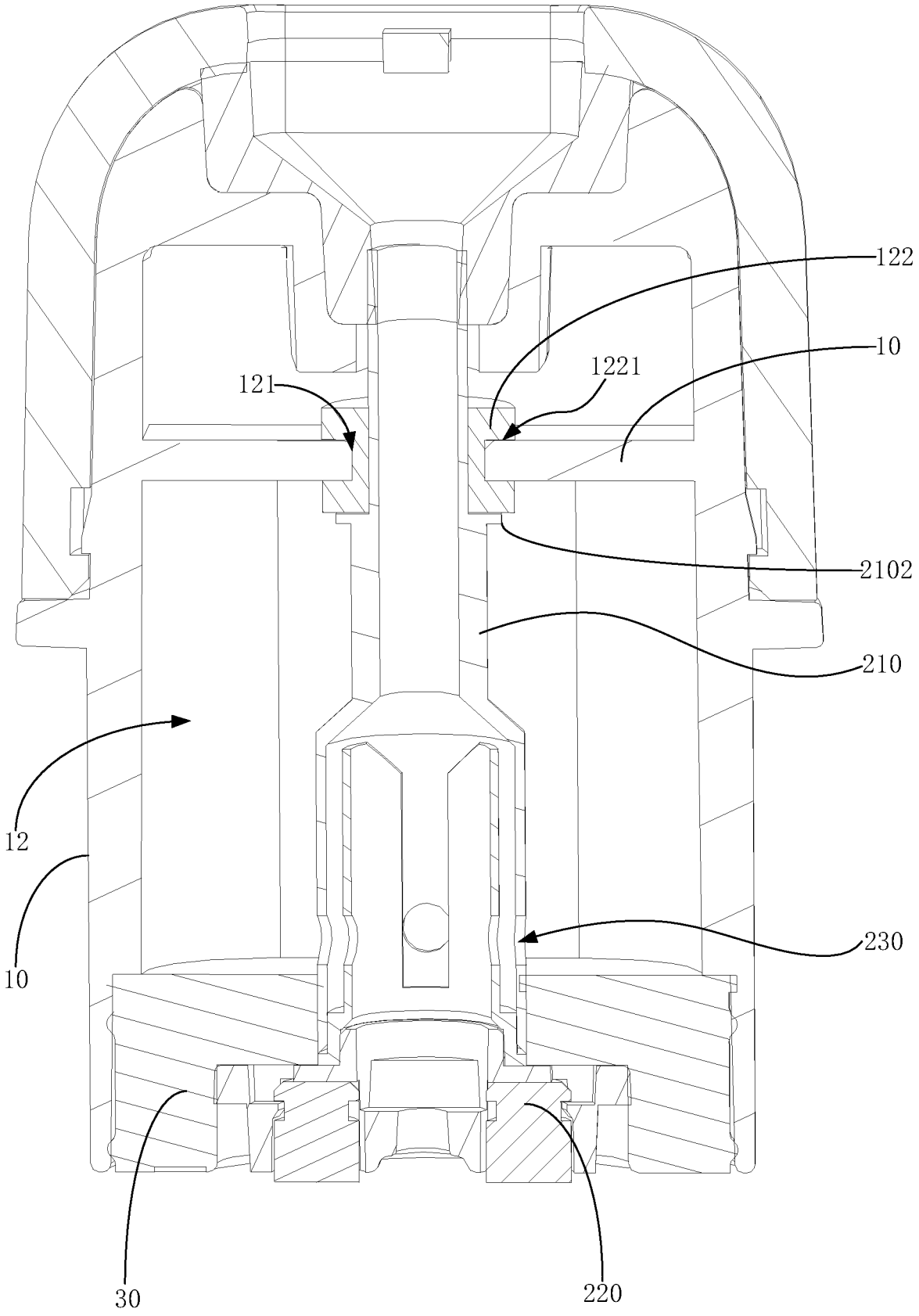
FIG. 11 is a schematic view showing the connection structure when the atomizing core component is at the second position of base in the third embodiment of present disclosure.
Figure 12:
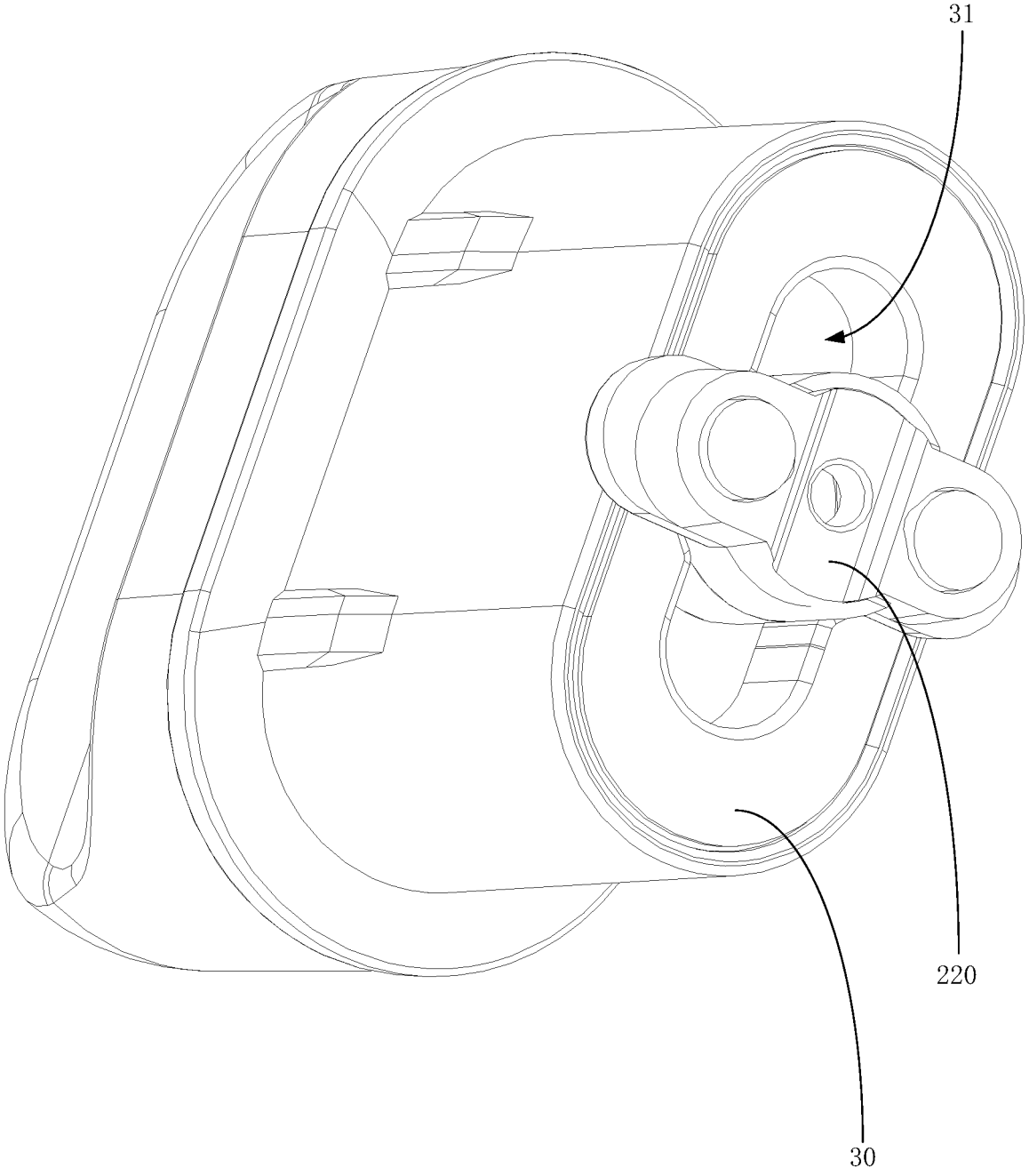
FIG. 12 is a schematic view showing the connection structure when the atomizing core component of electronic cigarette is at the first position of base under stopped statue in the second or third embodiment of present disclosure.

Furthermore, as shown in FIG. 3, FIG. 10, or FIG. 11, when the second part 220 is squeezed by external force, the atomizing core component 200 can move into the base 100 until reach the second position of the base 100, then the juice guide hole 230 can connect with the juice storage cavity 12, so that the juice stored inside the juice storage cavity 12 cannot penetrate into the atomizing core component 200 through the juice guide hole 230. After final assembly, it can be used normally.

In some embodiments, the base 100 is not limited to the above-mentioned case 10 with the elastic sealing seat 30, so that the juice guide hole 230 can be elastically covered and sealed by the seal seat 30 when the atomizing core component 200 is pre-installed at the first position. For example, in other embodiments of present disclosure, the seal seat 30 and the case 10 both are made of hard material, and flexible sleeves are sleeved on the position where the juice guide hole 230 is provided on the atomizing core component 200. In some embodiments, when the atomizing core component 200 is inserted into the first position, the sleeve can elastically abut against the inner wall of the installation cavity 31. In some embodiments, when the atomizing core component 200 is inserted into the first position, outer surface of the atomizing core component 200 can abut against the inner wall of installation cavity 31 provided on the seal seat 30 to achieve cover and a seal. Both of these embodiments fall in the scope of protection in the present disclosure.

Specifically, as shown in FIG. 9 or FIG. 10, in some embodiments of present disclosure, a partition section 17 is provided inside the case 10 to form the juice storage cavity 12 in part of internal space of case 10, and the other part forms the installation cavity 31 along with the space above the seal seat 30. For example, the inner wall space on the left side of case 10 is the juice storage cavity 12, and the space on the right side of case 10 forms the installation cavity 31 along with the space above the seal seat 30. In some embodiments, when the seal seat 30 is installed on the case 10, the opening 11 is blocked and make the juice storage cavity 12 and part of the installation cavity 31 form two independent chambers in the case 10. Then, the passing juice orifice 171 is provided through the partition section 17. In some embodiments, when the atomizing core component 200 is pre-installed on the first position, part of the first part 210 of atomizing core component 200 passes through the seal seat 30 and accommodates in the installation cavity 31 inside the case 10 and tightly attaches to the partition section 17 to prevent leakage of juice in the juice storage cavity 12 through the passing juice orifice 171 during transportation. After purchase, the user only needs to apply pressure to the second part 220 of atomizing core component 200 to continuously press the atomizing core component 200 into the installation cavity 31, so that the juice guide hole 230 provided on the atomizing core component 200 can be aligned to the passing juice orifice, further enable the juice stored in the juice storage cavity may flow into the atomizing core component 200 through the passing juice orifice 171.

In some embodiments of the present disclosure, the installation cavity 31 and the juice storage cavity 12 are not limited by the left and right separated arrangement mentioned in above embodiments. For example, in some embodiments, the separated arrangement of the installation cavity 31 and the juice storage cavity 12 may be replaced by right and left separated arrangement, up and down separated arrangement, up and down separation, staggered separation, or the like.

Furthermore, in order to ensure the juice guide hole 230 is aligned to the passing juice orifice 171 when the atomizing core component 200 is installed on the second position of the base, cross section of the first part 210 of atomizing core component 200 is polygonal in the first embodiment of present disclosure. Juice guide hole 230 is provided on each surface of atomizing core component 200 to ensure that juice guide hole 230 is provided on the surface opposite to the partition section 17 when the atomizing core component 200 is pre-installed on the first position.

In some embodiments, it is not limited to adopt polygonal cross section of the first part 210 of atomizing core component 200. For example, a positioning part may be provided too, so that the atomizing core component 200 only can be pre-installed on the base 100 along specified direction to ensure that the alignment of the juice guide hole 230 and the passing juice orifice 171 when the atomizing core component 200 is pre-installed on the second position.

Furthermore, as shown in FIG. 10, to prevent the juice in the juice storage cavity 12 flowing to other parts of the base 100, it should be ensured that the juice from the juice storage cavity 12 only flows to the juice guide hole 230 through the passing juice orifice 171 when the juice guide hole 230 connects with the passing juice orifice 171. In an embodiment of present disclosure, the area of opening 11 of juice guide hole 230 is greater than that of opening 11 of passing juice orifice 171, so that the surface provided with the juice guide hole 230 of atomizing core component 200 can cover the outer edge of passing juice orifice 171 when the juice guide hole 230 is aligned and connects with the passing juice orifice 171, thus effectively ensure that juice in the juice storage cavity 12 flows into the juice guide hole 230 only through the passing juice orifice 171 when the juice guide hole 230 connects with the passing juice orifice 171.

Furthermore, it should be understood that, in actual application process, not limit to above embodiments, the installation cavity 31 and the juice storage cavity 12 are two independent chambers. For example, as shown in FIG. 1 or FIG. 3, in the second embodiment of the present disclosure The installation cavity 31 is provided on the seal seat 30 where directly opposites to the juice storage cavity 12, and the installation cavity 31 directly connects with the juice storage cavity 12. The case 10 is further provided with a hollow air duct 15, where one end of air duct 15 is inserted into the juice storage cavity 12, and the other end connects with outside. A hollow connecting tube 2101 is convexly provided on the first part 210 of atomizing core component 200. In some embodiments, when the atomizing core component 200 is pre-installed on the first position, the first part 210 of atomizing core component 200 can be inserted along the installation cavity 21 provided on the seal seat 30, and the end of connecting tube 2101 away from the first part 210 can be pre-inserted into the air duct 15, so that the atomizing cavity 240 in the atomizing core component 200 can connect with the air channel of air duct 15. At the same time, the juice guide hole 230 provided on the atomizing core component 200 is covered and sealed by the seal seat 30. In some embodiments, when the user applies squeezing force on the second part 220 of the atomizing core component 200 to push the atomizing core component 200 into the base 100 further until the second position, the juice guide hole 230 provided on the surface of the atomizing core component 200 can be exposed inside the juice storage cavity 12. Furthermore, the juice inside the juice storage cavity 12 may flow into the atomizing cavity 240 inside the atomizing core component 200 along the juice guide hole 230 and be atomized by heating components to generate smoke. Furthermore, the atomizing core component 200 is inserted into the juice storage cavity 12, so that the juice guide hole 230 can be directly exposed inside the juice storage cavity 12 to facilitate penetration of juice. A plurality of juice guide holes can be provided on the surface of the atomizing core component 200 to improve penetration rate further and ensure supply of juice during atomizing.

Specifically, as shown in FIG. 3, in the embodiment, the distance from the juice guide hole 230 to the second part 220 is slightly greater than the thickness of seals where the installation cavity 31 is provided, and the installation cavity 31 is provided at the bottom of the juice storage cavity 12. Therefore, when the atomizing core component 200 is inserted into the juice storage cavity 12 along the installation cavity 31 and reach the first position, the juice guide hole 230 is covered and sealed by the seal seat 30. In some embodiments, when the atomizing core component is further inserted and reach the second position, the juice guide hole 230 is just completely exposed inside the juice storage cavity 12 from the seal seat 47 and locates at the bottom of juice storage cavity 12. Therefore, juice can penetrate the atomizing cavity 240 through the juice guide hole 230 under the influence of gravity. Furthermore, the juice guide hole 230 locates at the bottom of the juice storage cavity 12, which may effectively prevent the juice residue at the bottom of juice storage cavity 12 due to a higher position of the juice guide hole 230.

Figure 4:
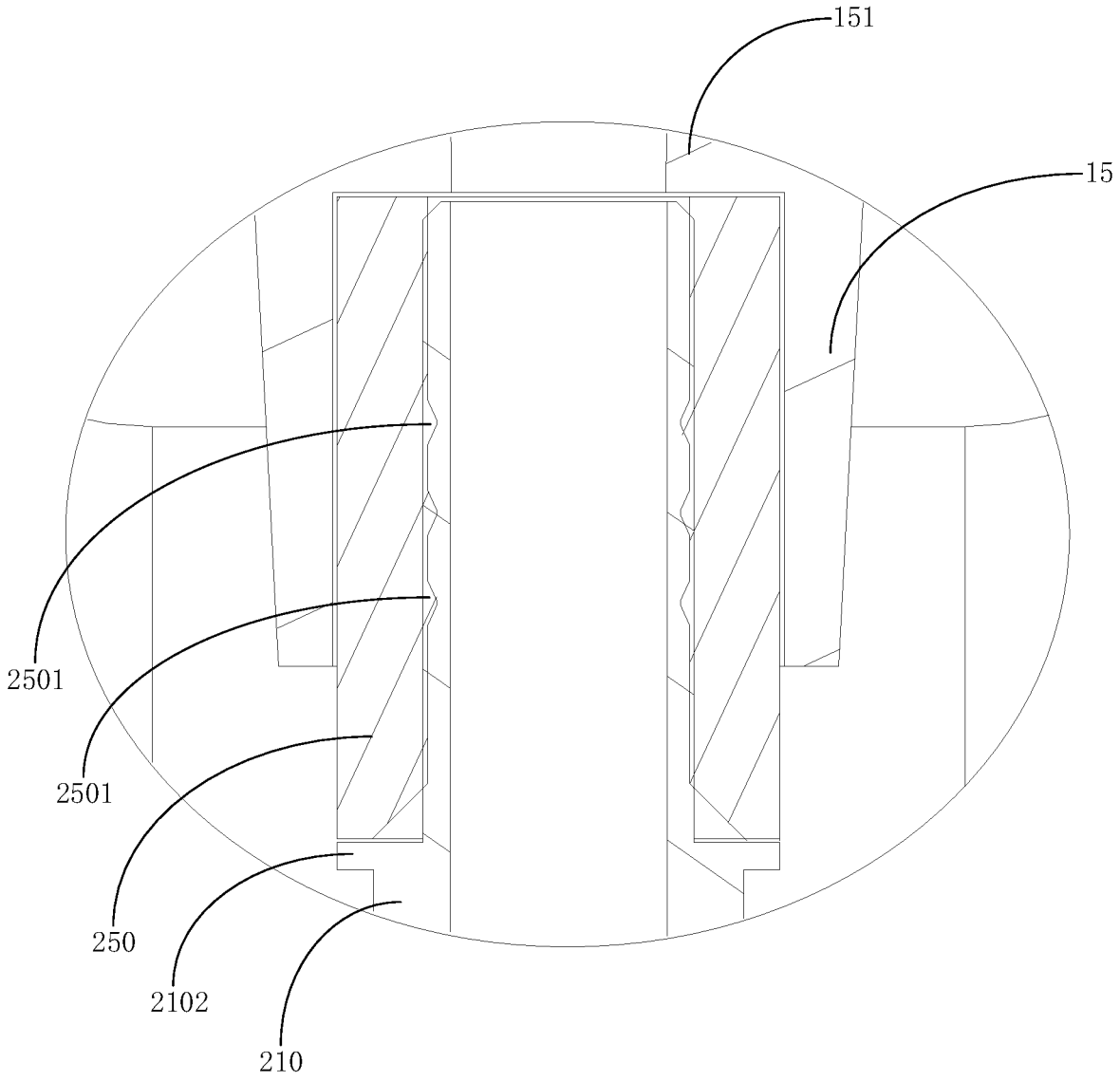
FIG. 4 is an enlarged schematic view of the connection structure at B in FIG. 3 of present disclosure.

Furthermore, as shown in FIG. 1, FIG. 3 or FIG. 4, in some embodiments, a seal ring 250 made of flexible material is further provided between the connecting tube 2101 and the air duct 15, such as the seal ring 250 made of elastic silicone, elastic plastic or elastic resin, etc. The inner ring surface of sealing ring is sleeved on the outer surface of first part, and the outer ring surface elastically abuts against the inner tube wall of the air duct 15, so that the air duct 15 can be tightly connected to the connecting tube 2101 to prevent leakage of juice between them.

Furthermore, as shown in FIG. 4, in some embodiments, the seal ring 250 is pre-installed in the air duct 15, and the opening 11 at the end of sealing ring 250 facing the installation cavity 31 is gradually expanded to form an inclined surface with guiding function. Additionally, or alternatively, in some embodiments, a wedge-shaped guide surface is provided on the outer edge of the connecting tube 2101 to prevent abutting due to offset during inserting the connecting tube 2101.

In some embodiments, the seal ring 250 is not limited to the one that pre-installed on the air duct 15 and with one gradually expanded end. For example, in some embodiments of present disclosure, the seal ring 250 may also be pre-sleeved on the peripheral surface of connecting tube 2101, and the end of connecting tube 2101 facing to the installation cavity 31 is gradually expanded to facilitate insertion.

Furthermore, as shown in FIG. 3 and FIG. 4, in some embodiments, a support ring 151 is further convexly provided on the inner wall of air duct 15, when the seal ring 250 is pre-installed inside the air duct 15, and the end of seal ring 250 away from the installation cavity 31 is supported by the support ring 151. At the same time, high stress beard by the seal ring 250 and over-insertion of air duct 15 should be prevented.

Furthermore, as shown in FIG. 1, FIG. 3 or FIG. 4, in some embodiments, the area of cross section enclosed by the inner ring surface of seal ring 250 is greater than the area of cross section enclosed by the inner ring surface of support ring 250. Therefore, the offset of seal ring 250 that may cover the inner ring surface of the support ring 151 and lead to low air flow rate should be effectively prevented.

Furthermore, as shown in FIG. 4, in some embodiments, at least one sealing convex rib 2501 is further convexly provided on the inner ring surface of seal ring 250 when the connecting tube 2101 is inserted into the seal ring 250, the surface of sealing convex rib 2501 is clamped on the peripheral surface of the connecting tube 2101.

Furthermore, as shown in FIG. 1, FIG. 3 or FIG. 4, in some embodiments, a limit stop 2102 is further convexly provided on the peripheral surface of the connecting tube 2101. In some embodiments, when the atomizing core component 200 is located on the first position, there is certain distance between the limit stop 2102 and the end surface of air duct 15. In some embodiments, when the atomizing core component 200 moves to the second position under external force, the limit stop 2102 is spaced with or abuts against on the end surface of air duct 15 to prevent users from exerting too much force, which can lead to deformation of the seal seat 30 and leakage of juice from the gap between the seal seat 30 and the case 10. For example, when an external force is applied on the atomizing core component 200, the atomizing core component 200 can move to a second position on the base until the limit stop 2102 abuts against the air duct 15, thus the atomizing core component 200 can stop moving.

In some embodiments, the limit stop 2102 is not limited to the one that abuts against the end surface of air duct 15 to prevent users from exerting too much force as mentioned in above embodiment. For example, as shown in FIG. 4, in other embodiments of present disclosure, the thickness of seal ring 250 can be larger to make one end of seal ring elastically abut against on the support ring 151 when the seat ring is pre-installed in the air duct 15, and the other end protrudes out of the air duct 15 and accommodates in the juice storage cavity 12. In some embodiments, the limit stop 2102 moves towards the seal ring 250 together with the atomizing core component 200 until the limit stop 2102 abuts against the seal ring during contact. Additionally, or alternatively, in some embodiments, there is a support bone position provided in the juice storage cavity 12, and the limit stop 2102 moves together with the atomizing core component 200 until the limit stop 2102 abuts against the support bone position. For example, when an external force is applied on the atomizing core component 200, the atomizing core component 200 can move to a second position on the base until the limit stop 2102 abuts against the seal ring 250, thus the atomizing core component 200 can stop moving.

Figure 8:
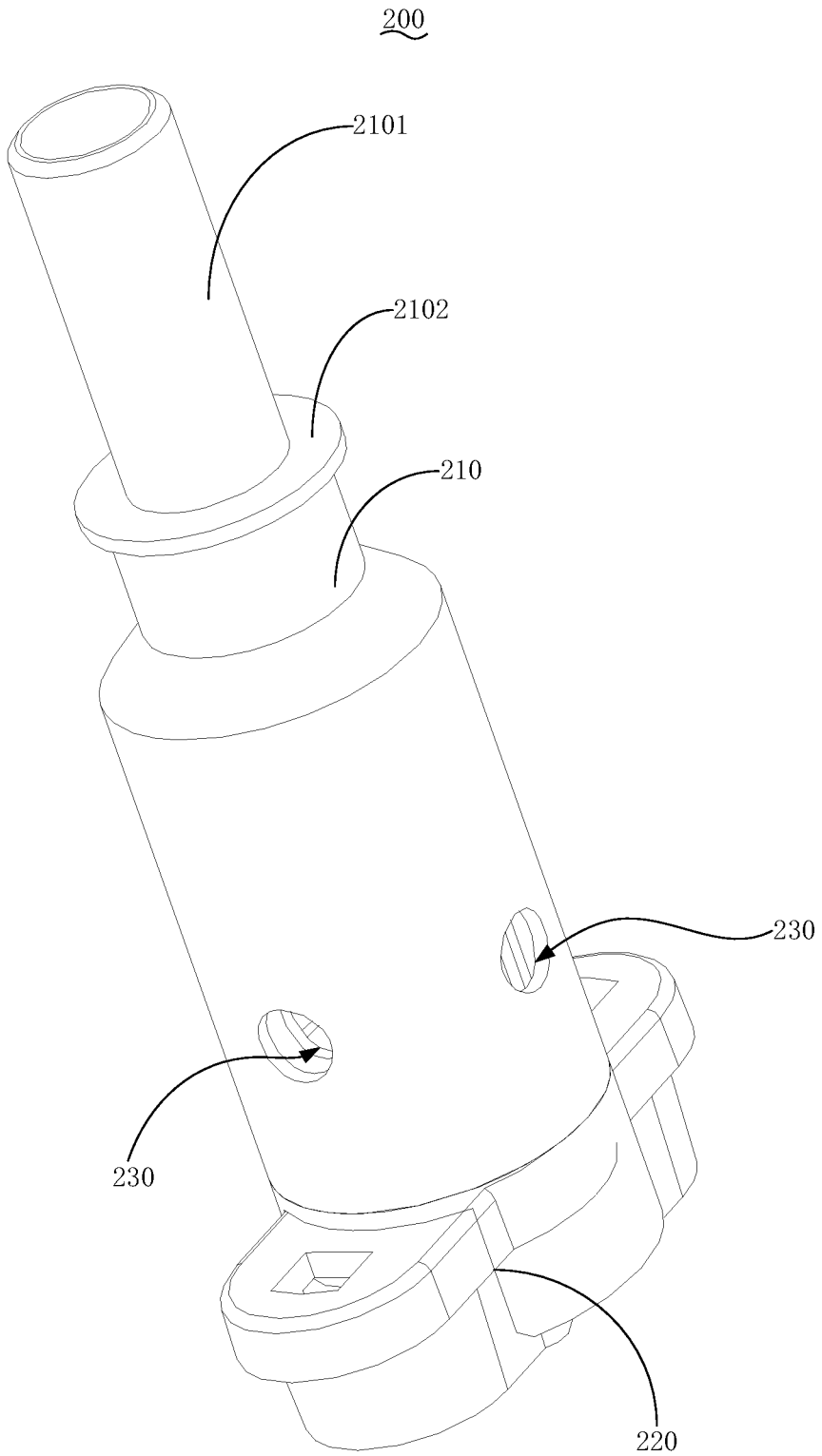
FIG. 8 is an exploded schematic view of connection structure of atomizing core component in the electronic cigarette atomizing device of present disclosure.

Specifically, as shown in FIG. 8, in some embodiments of the present disclosure, the limit stop 2102 is optionally selected from a plurality of bumps 33 convexly provided on the peripheral surface of connecting tube 2101 or the shoulder-shaped convex edge provided along the circumferential direction. In some embodiments, a shoulder-shaped convex edge is integratedly molded on the peripheral surface of connecting tube 2101, so that the force can be more uniformed when it abuts against other parts to facilitate machining.

In some embodiments, the air duct 15 is not limited by above embodiments in the way inserted into the juice storage cavity 12. For example, as shown in FIG. 11, the air duct 15 also can be accommodated outside the juice storage cavity 12, and an escape hole 121 that connects with the air duct 15 is provided on the inner wall of juice storage cavity 12 and is directly opposite of the hollow position of the air duct 15. The other parts are basically consistent with the embodiments described herein of the present disclosure and will not be described in detail hereinafter.

In some embodiments, when the atomizing core component 200 is pre-installed at the first position on the base 100, the connecting tube 2101 on the first part 210 is inserted into the air duct 15 after passing through the installation cavity 31, the juice storage cavity 12, and the escape hole 121 in turn. In some embodiments, when the atomizing core component 200 moves from the first position to the second position, the juice guide hole 230 is in the juice storage cavity 12 to prevent leakage of juice during transportation.

Furthermore, as shown in FIG. 11, for preventing leakage of juice from the gap between the connecting tube 2101 and the escape hole 121, in some embodiments of present disclosure, the seal sleeve 122 is further provided between the connecting tube 2101 and the escape hole 121, the inner surface of seal sleeve 122 is sleeved on the peripheral surface of connecting tube 2101, and the peripheral surface of seal sleeve 122 is elastically abutted against the inner hole wall of escape hole 121 to prevent leakage of juice.

Specifically, as shown in FIG. 11, the seal groove 1221 is further provided along the circumferential direction on the peripheral surface of seal sleeve 122, so that the cross section of seal sleeve 122 can be approximately I-shaped, and the groove wall on two sides of seal groove 1221 can form two flexible clamping arms. In some embodiments, when the seal sleeve 122 is pre-installed inside the escape hole 121, the two flexible clamping arms can respectively cover the edges at two ends of escape hole 121, so that the inner hole wall of escape hole 121 can be covered, and the two flexible clamping arms can clamp the edges at two ends of escape hole 121 inside the seal groove 1221 for fixing. It effectively prevents the seal sleeve 122 from escaping from the escape hole 121.

In some embodiments, the seal sleeve 122 is not limited to the manner wherein the seal groove 1221 is pre-installed in the escape hole 121. For example, the length of seal sleeve 122 may also be set to be greater than the depth of escape hole 121. Then, the sleeve of seal sleeve 122 is on part of peripheral surface of first part 210, so that the peripheral surface of seal sleeve 122 can tightly abut against the inner hole wall of escape hole 121 when the atomizing core component 200 is at the first position and the second position on the base 100, which can effective prevent leakage of juice from the gap between the seal sleeve 122 and the escape hole 121.

Furthermore, as shown in FIG. 1 or FIG. 3, in some embodiments of the present disclosure, the opening 11 of case 10 is a stepped counterbore, and one end of seal seat 30 is inserted into the opening 11 and abuts on the step of counterbore. The sealing seat 30 is supported and limited by the steps, which effectively prevents the seal seat 30 from excessively inserted into the case 10 under excessive external squeezing force.

In some embodiments, it is not limited to the above-mentioned method of supporting and limiting the seal seat 30 by providing a step inside the case 10. For example, in some embodiments of the present disclosure, a flange (not illustrated) may be provided on the outer periphery of one end of seal seat 30, so that when the seal seat 30 is installed on the case 10, one end of the seal seat can be inserted into the case 10, and the flange provided on the other can abut against the end edge of the opening 11 of case 10 to prevent the seal seat 30 from excessively inserted into the case 10 under excessive external squeezing force.

Specifically, as shown in FIG. 3, when the seal seat 30 is installed in the case 10, the outer end surface of seal seat 30 is lower than the outer end surface of the end of case 10 provided with the opening 11 or aligned vertically with the outer end surface of the end of case 10 provided with the opening 11. It further effectively prevents the seal seat 30 from partially protruding out of the case 10 and being easily contacted by external objects to generate squeezing force, resulting in a gap between the seal seat 30 and the case 10.

Figure 5:
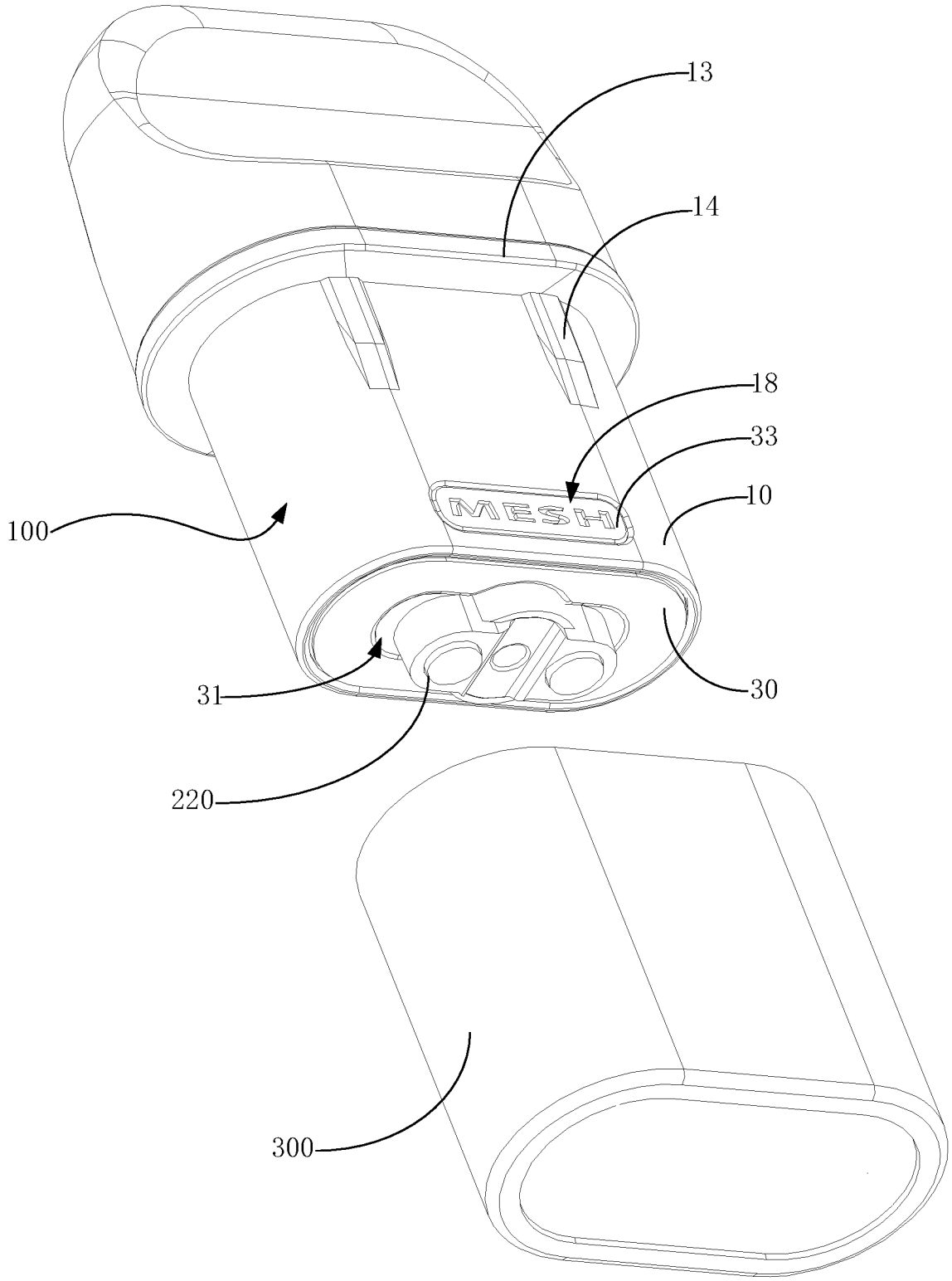
FIG. 5 is an exploded schematic view of the connection structure of protective cover and the base loaded with the atomizing core component in the electronic cigarette atomizing device of the present disclosure.

Furthermore, as shown in FIG. 5, a groove 18 is further provided on the outer peripheral surface of case 10 corresponding to the seal seat 30 to expose part of the lateral wall of seal seat 30. The groove 18 exposes part of lateral wall of seal seat 30 to form the buckle groove 18, so that it can effectively facilitate the user for disassembling the seal seat 30 from the case 10 through the groove 18 later.

Specifically, as shown in FIG. 5, the outer peripheral surface of seal seat 30 is convexly provided with a bump 33 adapted to the groove 18. The bump 33 and the seal seat 30 are integrally formed, and both are made of elastic materials, so they can be pressed inside along the opening 11 of case 10. In some embodiments, when the bump 33 is pressed into and directly opposites to the groove 18, the bump 33 can recover the deformation and be clamped in the groove 18, which further effectively prevents the seal seat 30 from offset and deforming under squeezing by external force. At the same time, the bump 33 protruding into the groove 18 is helpful for the user to exert a force to disassemble the seal seat 30. At the same time, other elements, such as product logo, may be provided on the outer end surface of bump 33 facing the opening 11 of the groove 18 to improve the aesthetic performance of the product, and it is not necessary to sculpt the logo on other location, which will effectively save the production cost.

Figure 6:
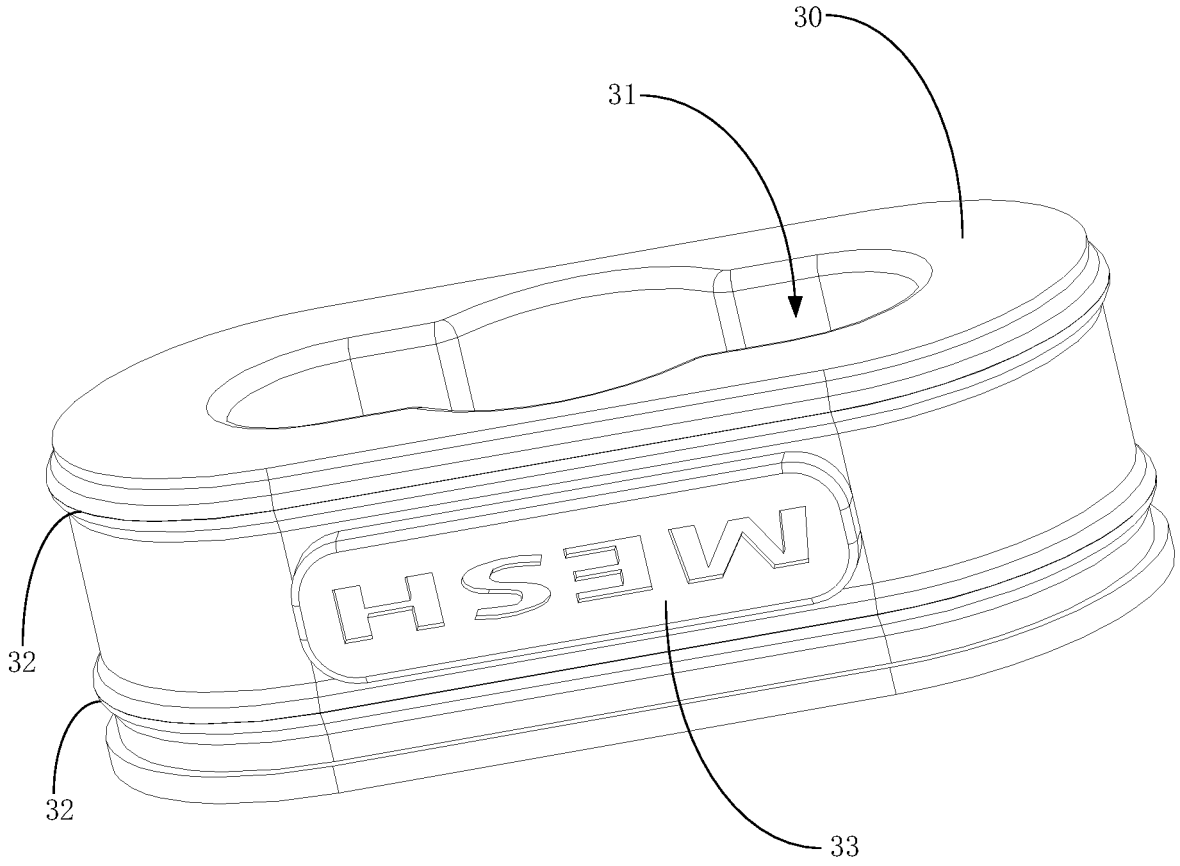
FIG. 6 is a three-dimensional schematic view of the connection structure of seal seat in the electronic cigarette atomizing device of present disclosure.

Furthermore, as shown in FIG. 6, the surface of seal seat 30 contacting the case 10 is provided with sealing convex edge 32 at intervals along the direction of insertion of the seal seat 30, and the sealing convex edge 32 extends along the circumferential direction of the seal seat 30 and forms integrally with the sealing seat 30, thereby effectively enhancing the interference. At the same time, a plurality of sealing convex edges 32 further ensure that the juice cannot leak out of the gap between the seal seat 30 and the case 10.

Specifically, as shown in FIG. 8, the area of cross section enclosed by the outer periphery of second part 220 of atomizing core component 200 is greater than the area of the cross section enclosed the outer periphery of first part 210, so that the second part 220 of atomizing core component 200 can protrude out of the outer periphery of first part 210. In some embodiments, when inserted into the base 100 along part of the installation cavity 31 provided along the seal seat 30, the second part 220 abuts the outer end surface of seal seat 30, which will effectively prevent the user from exerting excessive pressure when inserting and damage of internal components.

Figure 7:
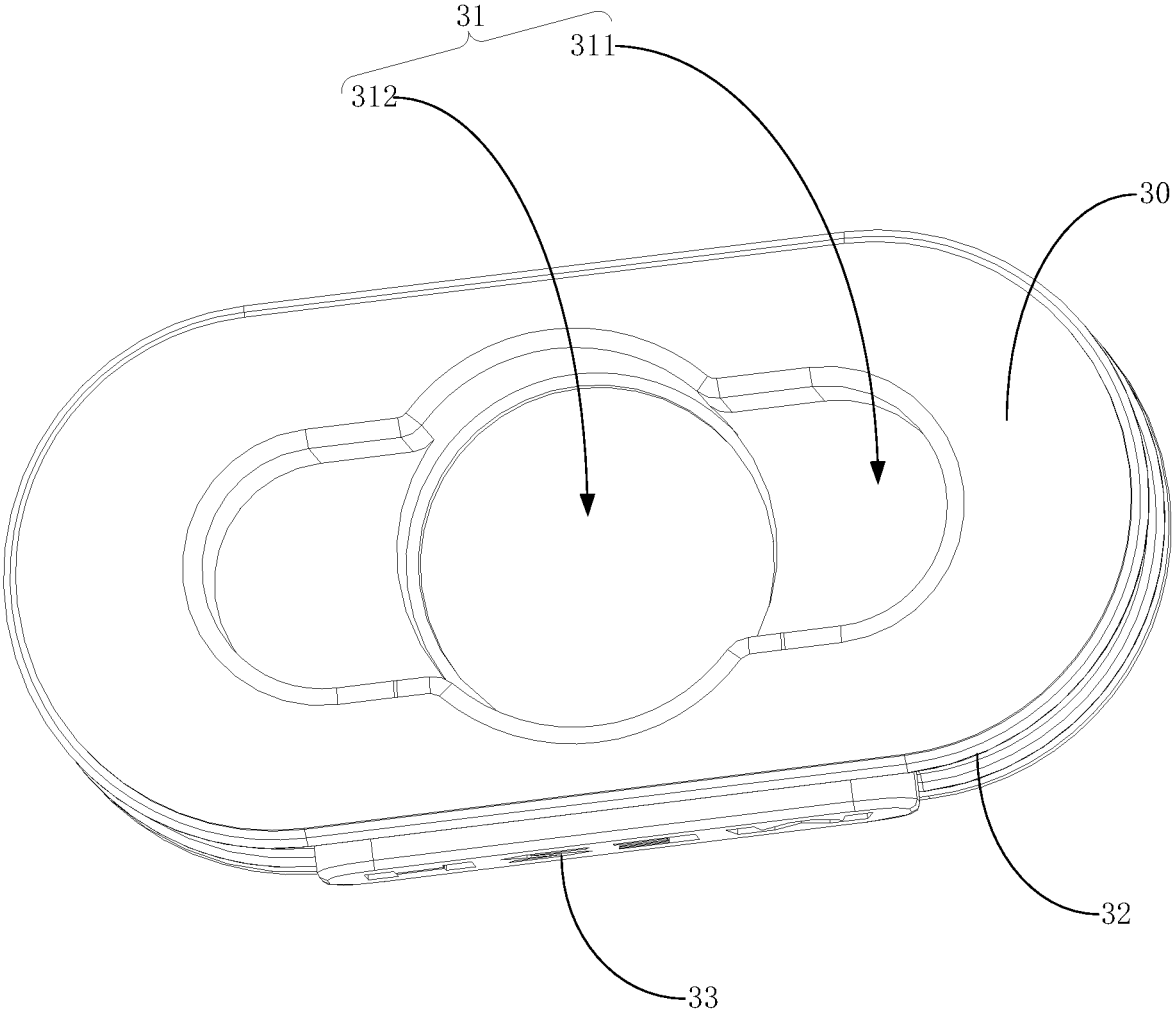
FIG. 7 is an exploded schematic view of connection structure of seal seat in the electronic cigarette atomizing device of present disclosure from another perspective.

Specifically, as shown in FIG. 7, the installation cavity 31 provided in the seal seat 30 includes a large diameter section 311 and a small diameter section 312 which are sequentially arranged from the outside of opening 11 of case 10 to the inside of opening 11 of case 10. In some embodiments, when the atomizing core component 200 is inserted along the installation cavity 31, the first part 210 is first elastically inserted into the small diameter section 312. In some embodiments, when the inserted second part 220 is inserted into the large diameter section 311, the large diameter section 311 can exert an elastic interference force on the outer periphery of the second part 220, so the pressure required to be applied needs to be strengthened, thus forming a hand-positioned alignment, and then forms the first position at the assembly station. In some embodiments, when further pressure is applied to the second part 220, the second part 220 can be pressed into the large diameter section 311 and contact with the periphery of small diameter section 312 in the installation cavity 31. Because the cross-sectional area of cross section of second part 220 is larger than the cross-sectional area of cross section of small diameter section 312, the position is limited due to abut, and the second part 220 is formed. It effectively facilitates assembly by user. At the same time, by accommodating second part 220 in the large diameter section 311 of installation cavity 31, the volume of atomizing device 1000 is effectively reduced, thereby reducing the overall volume of the product to make it easy to carry by user.

In some embodiments, as shown in FIG. 7, the first position is not limited to that when the second part 220 is sleeved on the large diameter section in above mentioned embodiment, the required feel of enhanced force is defined. For example, in some embodiments of the present disclosure, the large diameter section 311 includes a long axis and a short axis. In some embodiments, the small diameter section 312 is circular, and the second part 220 includes a long side and a short side. The length of the long side is larger than the length of short axis and smaller than or equal to the length of long axis, and the length of short side is equal to or slightly larger than the length of short axis. During installation, the second part 220 of atomizing core component 200 can be displaced from the large diameter section 311 of installation cavity 31, even if the long side is not installed directly align to the direction of the long axis. For example, the long side corresponds to direction of the short axis during installation. The first part 210 of atomizing core component 200 is firstly inserted into the circular small-diameter section 312. In some embodiments, when the second part 220 is inserted and contacts with the outer edge of short axis, the long side can not be inserted and can abut against the limit position due to large size, then forming the first position and in the stop state. In some embodiments, when the user further installs, firstly rotate the second part 220 from the first position until the long side and the long axis are directly aligned to release the stop state, the exert squeezes force to make the second part 220 accommodate in the large diameter section 311. Moreover, this method can effectively prevent the second part 220 from squeezed by mistake and moves from the first position to the second position during transportation. It may further effectively prevent juice leakage during transportation.

Specifically, the shapes of the large diameter section 311 and the second part 220 may be adapted to be polygonal, elliptical, or slotted hole shapes. In some embodiments, in order to facilitate the disassembly of atomizing core component 200, a buckle groove is provided on one side wall of the large diameter section 311, so that the outer peripheral surface of second part 220 is exposed, or the long side of second part 220 is designed to be slightly smaller than the long axis of large diameter section 311.

And when the atomizing core component is inserted into the second position, the outer end surface of second part is lower than or aligned vertically the outer end face of seal seat, which can effectively prevent the atomizing core component from being easily pulled out.

In some embodiments, the first position is not limited to that when the second part 220 is stagger-abutted against the large diameter section 311 in above mentioned embodiment, then rotate to prevent the second part 220 from being accidentally pressed into the installation cavity 31. For example, in other embodiments of present disclosure, the atomizing device 1000 may further be provided with a protective cover 300, and the protective cover 300 may be detachably installed on the base 100. In some embodiments, when the atomizing core component 200 is pre-installed in the first position of base 100, the first part 210 is inserted into the installation cavity 31, and the second part 220 is covered by the protective cover 300 in the base 100, which can effectively prevent the second part 220 from being squeezed by mistake and pressed into the installation cavity 31. Additionally, in some embodiments, the protective cover 300 can effectively prevent juice from leaking between the small diameter section 312 and the first part 210 when the atomizing core component 200 is in the first position and is rotated to the second position.

Specifically, as shown in FIG. 5, in one embodiment of the present disclosure, the protective cover 300 is fastened to the end of case 10 where the opening 11 is provided, and when the protective cover 300 covers the second part 220 at the first position inside the base 100, the side of second part 220 facing away from the base 100 can be fitted or spaced between the inner cavity wall of protective cover 300, and a stop part 13 is convexly formed on the outer periphery of the case. In some embodiments, the protective cover 300 can abut the stop part 13 when the protective cover is buckled on the case 10. In some embodiments, when the protective case is pressed under external force, the stop part 13 can provide certain support to the protective case, and the second part 220 and the seal seat 30 can not be displaced or deformed without being pressed by external force.

Specifically, as shown in FIG. 1, FIG. 3 or FIG. 5, the stop part 13 is a shoulder-shaped convex edge, so that the support force of the stop part 13 to the protective case can be more uniformed, and the product is more beautiful.

Specifically, the outer edge surface of shoulder-shaped convex edge protrudes outside the peripheral surface of protective cover 300, so as to provide height difference between the protective cover 300 and the shoulder-shaped convex edge when the protective cover 300 is buckled on the case 10, because a step is formed. In some embodiments, when the user needs to pull out the protective cover 300, the step shows certain limit to the user's finger, which is convenient for the user to apply a force.

Specifically, as shown in FIG. 5, one of the inner cavity surfaces of protective cover 300 and the outer peripheral surface corresponding to the base 100 is convexly provided with at least one clamp part 14 to achieve interference fit connection with the other surface of them. At this point, in this exemplary embodiment, the clamp part 14 may be a wave point provided on the outer surface of case 10 for interference clamping with the inner wall of protective cover 300 to make the protective case buckled on the case 10. Alternatively, a convex edge protruding from the surface of case 10 may be provided. For example, the convex edge can extend from the end adjacent to the stop part 13 toward the end of the opening 11 of the case 10 and the height of end of convex edge towards the opening 11 of case 10 can protrude out of the surface of the case 10 lower than the height of convex edge close to the stop part 13, thereby forming a wedge-shaped guide surface to facilitate insertion of the entire base 100 into the cavity of the protective cover 300.

In some embodiments, the clamp part 14 is not limited to be provided on the outer peripheral surface of the case 10 in above mentioned embodiment. For example, in some embodiments, clamp part 14 may also be provided in the cavity inside the protective cover 300, the manner of interference clamping with the outer surface of case 10.

Specifically, both the cover body and the case 10 are made of light-transmitting materials, which is effective for the user to observe the remaining amount of juice stored in the case 10 to avoid low juice level and paste core.

Further, the power supply device is provided with a receiving cavity corresponding to the atomizing device 1000, when the atomizing device 1000 is inserted into the receiving cavity, the end of base 100 provided with the atomizing core component 200 is inserted into the receiving cavity, and the stop part 13 is abutted against the outer cavity edge of receiving cavity upon contact to effectively prevent the atomizing core component 200 from being excessively inserted into the power supply device, resulting in excessive squeezing of the output pin inside the power supply device which can lead to damage. At the same time, the clamp part 14 protruding from the outer peripheral surface of case 10 is interference-fitted with the inner surface of receiving cavity, so as to partially fix the case 10 in the receiving cavity.

Specifically, the stop part 13 and corresponding case 10 are made of light-transmitting materials. Therefore, when the atomizing device 1000 is partially inserted into the receiving cavity, the stop part 13 is accommodated in the receiving cavity to form a window for the user to observe the remaining juice level inside the case 10, to further prevent the case 10 of the atomizing device 1000 from being inserted into the power supply device during use, resulting in the user being unable to observe the remaining juice level inside the case 10.

Figure 2:
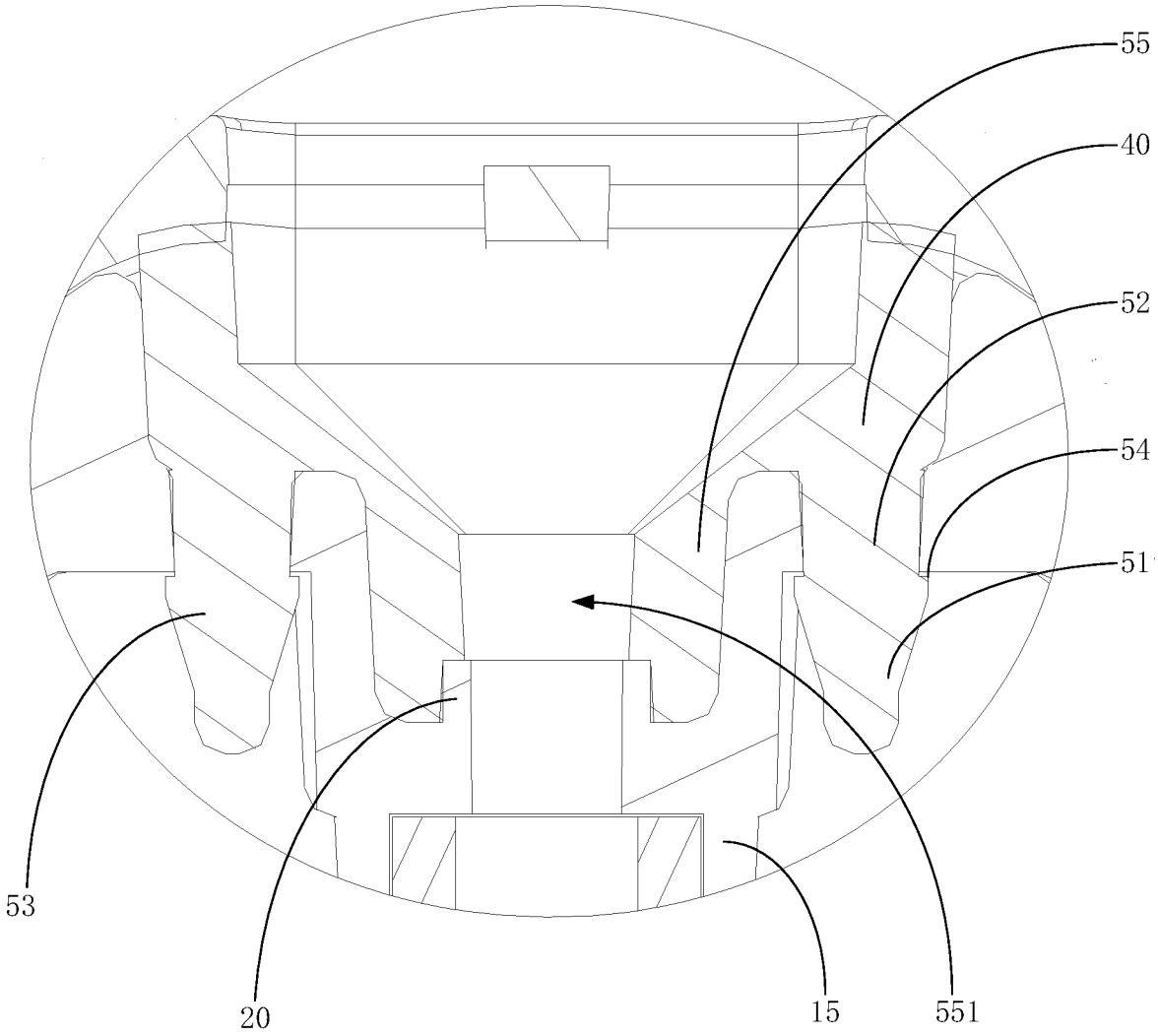
FIG. 2 is an enlarged schematic view of the connection structure at A in FIG. 1 of present disclosure.

Specifically, as shown in FIG. 1 to FIG. 3, the case 10 is further provided with a juice injection hole 16 and a juice stop plug 50 for sealing the juice injection hole 16 by the user. In some embodiments, when the atomizing core component 200 is installed on the first position of the base 100, juice is injected through the juice injection hole 16. After the juice is injected, the juice stop plug 50 is inserted into the juice injection hole 16 with a tight interference to close the juice injection hole 16.

Specifically, if the atomizing device 1000 is applied to a disposable electronic cigarette, capacity of the built-in battery in the power supply device is slightly greater than the amount of electricity required by atomization of pre-stored juice using the atomizing device 1000. For example, 5% or 10% greater than required amount of electricity to prevent power loss during transportation and sale cycle. In this embodiment, the juice stop plug 50 includes a plug head 51 and a plug body 52 that are sequentially inserted into the juice injection hole 16. For example, when the juice stop plug 50 is inserted into the juice injection hole 16 with interference, the outer end surface of plug body 52 is lower than the surface of outer edge of juice injection hole 16 or aligned vertically with the surface of outer edge of juice injection hole 16, so that the juice stop plug 50 is completely accommodated in the juice injection hole 16. Therefore, it is difficult to pull out the juice stop plug again to inject juice and form the closed-type disposable atomizing device 1000. It can effectively prevent the user from refilling juice after the pre-stored juice in the juice storage cavity 12 is used up while the battery still has a certain amount of residual power, resulting in the waste of juice.

Specifically, as shown in FIG. 1 or FIG. 2, the outer diameter of juice stop plug 50 gradually increases from the plug head 51 to the plug body 52. In some embodiments, when the juice stop plug 50 is inserted into the juice injection hole 16, the end with small diameter is easier to be inserted into the juice injection hole 16, and the outer diameter of juice stop plug 50 gradually increases to interfere with the inner hole wall of the juice injection hole 16 during the insertion process. It effectively facilitates installation by user.

Specifically, as shown in FIG. 1 or FIG. 2, the outer diameter of plug head 51 is smaller than the diameter of juice injection hole 16, and the outer diameter of plug body 52 is equal to or slightly larger than the diameter of juice injection hole 16. By designing the outer diameter of plug head 51 to be smaller than the diameter of juice injection hole 16, there can be no sensation of resistance due to abutting during direct insertion. During the process of gradual insertion, the outer diameter of plug body 52 is equal to the outer diameter of juice injection hole 16, or when it is larger than the outer diameter of the juice injection hole 16, fixation is achieved through interference fit, which is more convenient for the user to install. At the same time, the outer diameter of plug body 52 of the juice stop plug 50 and the method for those skilled in the art to select a suitable outer diameter value according to their elastic deformation performance under the concept of present disclosure also fall within the protection scope of present disclosure.

Some embodiments are not limited to the above-described embodiment in which the plug head 51 is smaller and the plug body 52 is larger. For example, in other embodiments of present disclosure, the opening 11 of juice injection hole 16 facing outside can also be designed to be gradually expanded, so as to facilitate the way of inserting the juice stop plug 50. In some embodiments, an inner diameter of the juice injection hole 16 can be designed to gradually increase from the inside to the outside.

Specifically, the cross sections of juice stop plug 50 and the juice injection hole 16 are central symmetry, for example, any one of circular, oval, rectangular, oblong hole, etc., so that the juice stop plug 50 can be inserted along different directions and different angles, further facilitating installation by user. In some embodiments, the juice injection hole 16 has a round hole shape.

Furthermore, as shown in FIG. 3, a locking part 53 is convexly provided on the outer periphery of plug head 51 of juice stop plug 50, and the locking part 53 is integrally formed with the juice stop plug 50. In some embodiments, when the plug head 51 of juice stop plug 50 is inserted into the juice injection hole 16, the locking part 53 deforms under the squeezing force. In some embodiments, when the juice stop plug 50 is inserted along the juice injection hole 16 until the locking part 53 completely pass through the juice injection hole 16, the locking part 53 restores from deformation to abut against the inner edge of the juice injection hole 16. Therefore, further preventing the juice stop plug 50 from being pulled out.

Specifically, as shown in FIG. 3, the locking part 53 is a bump 33 or a flange convexly provided on the outer periphery of the juice stop plug 50, and the locking part 53 is firstly inserted into one side (curved face or wedge-shaped surface setting, such as round table setting) of the juice injection hole 16 to facilitate the insertion of the locking part 53, the smaller end is easy to insert, and the larger end abuts against the inner periphery of the juice injection hole 16 and difficult to be pulled out.

Specifically, as shown in FIG. 1 or FIG. 3, the juice injection hole 16 is a counterbore, and a stop edge 54 is further convexly provided on the end edge of the plug body 52 of the juice stop plug 50. In some embodiments, when the juice stop plug 50 is inserted into the juice injection hole 16, the plug head 51 passes through the small diameter hole of the counterbore, and the stop edge 54 of the plug body 52 is inserted into the large diameter hole of the counterbore and abut against the inner hole wall of the counterbore for position limit. The stop edge 54 and the counterbore-shaped juice injection hole 16 are provided to prevent the juice stop plug 50 from completely passing through the juice injection hole 16 and entering the juice storage cavity 12.

Specifically, in some embodiments of the present disclosure, a sealing seat 30 is installed at the bottom of case 10, and the atomizing core component 200 is inserted from the seal seat 30 at the bottom of case 10 and is coupled to the air duct 15 at the top of the case 10. In some embodiments, a vent hole is formed on the side of the air duct 15 connecting with the outside of the device, for a user to smoke.

To facilitate juice injection, the juice injection holes 16 is set to two, so that the juice can be injected into one of the injection holes 16 during the juice injection process, and the other juice injection hole 16 exhaust. Furthermore, the juice injection hole 16 is provided on the top of case 10 to facilitate juice injection.

At the same time, the atomizing device 1000 further includes the seals 40, and the seals 40 is made of silicone material. The seals 40 includes an installation seat 55 and two juice stop plugs 50 convexly provided on the surface of the seals 40. The vent hole is in the middle of two juice injection holes 16 and is lower than the plane set by the two juice injection holes 16 to form a stepped groove. In some embodiments, when the seals 40 is set on the base 100, the two-juice stop plugs 50 are inserted into the two juice injection holes 16 to block the two juice injection holes 16. The installation seat 55 is inserted into the stepped groove and is provided with an air passage 551 connecting with outside of the device, and the air passage 551 guides the airflow of the vent hole to the outside for the user to smoke. At this point, the vent hole is provided at the lower end of juice injection hole 16 and between the two juice injection holes 16, so that the seals 40 not only seal the juice injection hole 16, but also achieve positioning by inserted into the stepped groove to prevent deformation and surrounds the vent hole to guide the airflow. Due to the fast heat dissipation of silicone, the airflow can be cooled when passing through the air passage 551 to avoid hot in mouth.

Furthermore, an air guide edge 20 of case 10 is further convexly provided on the outer edge of vent hole. In some embodiments, when the installation seat 55 is inserted into the stepped groove, the air guide edge 20 can be inserted into the air passage 551, and the air channel in the air guide edge 20 can connect the air path of the air duct 15 and the air passage 551.

Furthermore, an accommodation slot 19 is further provided on the case 10, the two juice injection holes 16 are provided on the surface of the accommodation slot 19 facing the slot opening, and the seals 40 is accommodated in the accommodation slot 19 when installed in the case 10. It effectively prevents the seals 40 from completely protruding out of the case 10 and occupying large space.

The present disclosure also discloses an electronic cigarette. The electronic cigarette includes a power supply device for the electronic cigarette and an atomizing device 1000 for the electronic cigarette. The specific structure of atomizing device 1000 for the electronic cigarette refers to above mentioned embodiment. The electronic cigarette adopts all the technical schemes of all above embodiments, therefore have at least all the beneficial effects brought by the technical schemes of the above embodiments, which will not be repeated here.

The above only describes preferred embodiments of present disclosure and is not intended to limit the patent scope of present disclosure. Any equivalent structural transformation made by using contents of the description and drawings of the present disclosure, or directly or indirectly used in other relevant technical fields under the inventive concept of the present disclosure shall be included within the protection scope of patent of the present disclosure.

What is claimed is:

1. An atomizing device of an electronic cigarette, the atomizing device comprising:

a base comprising a juice storage cavity for accommodating cigarette liquid and an installation cavity coupled with the juice storage cavity; and an atomizing core component comprising:

a first part, a second part, and a juice guide hole that is coupled to an inner part of the atomizing core component and is provided on an outer wall of the atomizing core component between the first part and the second part;

wherein the atomizing core component is configured to be pre-installed on a first position on the base, and when the first part of the atomizing core component is inserted into the installation cavity, the second part of the atomizing core component protrudes outside of the base, and the juice guide hole is covered by the base;

wherein, when the second part of the atomizing core component is squeezed by an external force, the atomizing core component is configured to move to a second position on the base and the juice guide hole connects with the juice storage cavity.

2. The atomizing device of claim 1, wherein the juice guide hole is in the juice storage cavity when the atomizing core component is in the second position.

3. The atomizing device of claim 1, wherein the base further comprises a case that includes an opening and a seal seat, wherein the seal seat is configured to seal the opening and form the juice storage cavity with inner walls of the case, and the seal seat is provided with the installation cavity.

4. The atomizing device of claim 3, wherein the juice guide hole is covered by the seal seat when the atomizing core component is pre-installed at the first position on the base.

5. The atomizing device of claim 3, wherein the seal seat comprises a flexible sealing element, wherein when the first part of the atomizing core component is inserted into the installation cavity of the seal seat, the inner wall of the installation cavity is flexible and closely matched with the outer wall of the atomizing core component.

6. The atomizing device of claim 5, wherein when the second part of the atomizing core component is squeezed by an external force, the atomizing core component is configured to move towards the base relative to the seal seat.

7. The atomizing device of claim 1, wherein the base further comprises an air duct, wherein one end of the air duct protrudes outside of the atomizing device and the other end of the air duct is inserted into the juice storage cavity, wherein when the atomizing core component is pre-installed at the first position on the base, the first part of the atomizing core component is inserted into the air duct through the installation cavity.

8. The atomizing device of claim 7, wherein the juice guide hole is in the juice storage cavity when the atomizing core component is in the second position.

9. The atomizing device of claim 7, further comprising a sealing ring positioned between the first part and the air duct, wherein an inner ring surface of the sealing ring is sleeved on the outer surface of the first part of the atomizing core component, and an outer ring surface of the sealing ring elastically abuts against an inner tube wall of the air duct.

10. The atomizing device of claim 9, wherein the seal ring is pre-installed on the air duct and opening the inner ring surface at an end of the sealing ring facing the installation cavity is configured to gradually expand.

11. The atomizing device of claim 9, further comprising a support ring, the support ring protruding on an inner wall of the air duct, wherein when the seal ring is pre-installed inside the air duct, the end away from the installation cavity elastically abuts against the support ring.

12. The atomizing device of claim 9, wherein a cross-section enclosed by the inner ring surface of the sealing ring is greater than a cross-section enclosed by the inner ring surface of the support ring.

13. The atomizing device of claim 7, further comprising a limit stop, the limit stop protruding on a peripheral surface of the first part of the atomizing core component, wherein the limit stop is configured to limit the position of the atomizing core component when abutting against the air duct.

14. The atomizing device of claim 13, wherein the limit stop is a shoulder-shaped flange or a bump extending along circumferential direction of the first part of the atomizing core component.

15. The atomizing device of claim 9, wherein an end of the sealing ring facing the installation cavity protrudes out of the air duct.

16. The atomizing device of claim 15, further comprising a limit stop, the limit stop protruding on a peripheral surface of the second part of the atomizing core component, wherein the limit stop is configured to limit the position of the atomizing core component when abutting against the seal ring.

17. The atomizing device of claim 16, wherein the limit stop is a shoulder-shaped convex edge or a projecting part extending along circumferential direction of the second part of the atomizing core component.

18. The atomizing device of claim 1, further comprising:
an escape hole; and
an air duct,
wherein one end of the air duct protrudes outside of the atomizing device, and the other end of the air duct is inserted into the juice storage cavity,
wherein the escape hole is on a wall of the juice storage cavity that is directly opposite to the air duct,
wherein when the atomizing core component is pre-installed at the first position on the base, the first part of the atomizing core component is inserted into the air duct after passing through the installation cavity, the juice storage cavity, and the escape hole.

19. The atomizing device of claim 18, wherein the juice guide hole is in the juice storage cavity when the atomizing core component is in the second position on the base.

20. The atomizing device of claim 18, further comprising a hollow seal sleeve, hollow seal sleeve positioned between the first part of the atomizing core component and an inner wall of the escape hole, wherein a peripheral surface of the seal sleeve is tightly fitted on an inner wall of escape hole.

21. The atomizing device of claim 20, further comprising a seal groove on the peripheral surface of the seal sleeve along a circumferential direction, wherein the seal sleeve is pre-installed inside the escape hole and is configured to make a hole edge at both ends of the escape hole inserted into the seal groove.

22. The atomizing device of claim 20, wherein the hollow seal sleeve is sleeved on part of a peripheral surface of the first part of the atomizing core component, and a length of the hollow seal sleeve is greater than a depth of the escape hole so that peripheral surface of the hollow seal sleeve can tightly abut against the inner wall of the escape hole when the atomizing core component is at the first position or the second position on the base.

23. The atomizing device of claim 1, wherein:
the juice storage cavity further comprises a passing juice orifice that is coupled to the installation cavity, and the installation cavity and the juice storage cavity are independent cavities in the base;
when the atomizing core component is pre-installed on the first position on the base, a peripheral surface of the atomizing core component is configured to block the passing juice orifice; and
when the atomizing core component moves from the first position on the base to the second position on the base, the juice guide hole is configured to connect to the passing juice orifice.

24. The atomizing device of claim 23, wherein a surface of a side of the atomizing core component that is directly opposite to the passing juice orifice is configured to tightly attach to an inner wall of the base where the passing juice orifice is located so that juice in the juice storage cavity is configured to pass the juice guide hole through the passing juice orifice when the juice guide hole is connected with the passing juice orifice.

25. The atomizing device of claim 23, wherein an opening of the juice guide hole is greater than an opening of the passing juice orifice.

26. An electronic cigarette comprising an atomizing device, the atomizing device comprising:
a base comprising a juice storage cavity for accommodating cigarette liquid and an installation cavity coupled with the juice storage cavity; and
an atomizing core component comprising:
a first part,
a second part, and
a juice guide hole that is coupled to an inner part of the atomizing core component and is provided on an outer wall of the atomizing core component between the first part and the second part;
wherein the atomizing core component is configured to be pre-installed on a first position on the base, and when the first part of the atomizing core component is inserted into the installation cavity, the second part of the atomizing core component protrudes outside of the base, and the juice guide hole is covered by the base;
wherein, when the second part of the atomizing core component is squeezed by an external force, the atomizing core component is configured to move to a second position on the base and the juice guide hole connects with the juice storage cavity.

* * * * *